US006059072A

United States Patent [19]

Cho

[11] Patent Number: 6,059,072

[45] Date of Patent: May 9, 2000

[54] ABSEIL RESCUE SYSTEM

[76] Inventor: Kunlin Cho, 17 Alley 1, Lane 43, Tapeng Road, Taichung, Taiwan

[21] Appl. No.: 08/987,002

[22] Filed: Dec. 8, 1997

[30] Foreign Application Priority Data

Jun. 13, 1996 [TW] Taiwan ..... 86108386

[51] Int. Cl.[7] ..... A62B 1/14

[52] U.S. Cl. ..... 182/193; 182/5; 182/72; 188/65.3

[58] Field of Search ..... 182/193, 197, 182/191, 5, 72; 188/65.3, 65.4, 65.5

[56] References Cited

U.S. PATENT DOCUMENTS 951,748 3/1910 Sorenson .

1,229,394 6/1917 Abramson .

4,883,146 11/1989 Varner .

*Primary Examiner*—Alvin Chin-Shue

*Attorney, Agent, or Firm*—Connolly & Hutz

[57] ABSTRACT

An abseil rescue system, comprising: a velocity control system with two brakes and two retarders; a rope winder with a rope; and a frame, having a base and a gallows with two height positions. The two brakes and the two retarders act on the rope, allowing for controlled and safe descent of a person. The base has a reel with a crank, where a transmission cord is wound up, which leads to the upper front end of the gallows, with a hook fastened to the free end of the transmission cord. By turning the crank, the gallows is brought in a high position to provide a high suspension point for the rope winder.

3 Claims, 6 Drawing Sheets

ABSEIL RESCUE SYSTEM

BACKGROUND OF THE INVENTION

1. Field of the Invention

The present invention relates to an abseil rescue system, particularly to an abseil rescue system having a rope with a high suspension point, where the velocity of descent is easily controllable.

2. Description of Related Art

An important feature of current abseil rescue systems is a stable velocity of descent, which is not dependent on the load. In an emergency, however, users, especially women and children, are often not able to suspend a heavy rope outside the wall along which they want to descend. After long storage, proper functioning of a slow descent is not assured, and there is no way to check this before use.

Traditionally only a slow descent of the user in the air is considered. How to mount the rope quickly and safely is not taken into account. For stabilizing the velocity of descent, mechanical devices are relied on. Variations of the weights of users and the risk of falling down are not considered in conventional designs.

Based on these reflections, in the present invention a complete rescue device has been designed, which covers all stages of the rescue, including activating and mounting the rescue device.

SUMMARY OF THE INVENTION

The present invention mainly comprises a velocity control system, a rope winder and a frame. The velocity control system has two retarders and two brakes. The frame comprises abase, a gallows with two height positions, fixed by a holding bar, a rope, reels, and a crank. By turning the crank, the reels are rotated, raising the gallows to provide a high suspension point for the user to escape.

An object of the present invention is to provide an abseil rescue system with a velocity control system.

Another object of the present invention is to provide an abseil rescue system with a rope winder, having a rope, which is released by pulling a cord.

The present invention can be more fully understood by reference to the following description and accompanying drawings.

DETAILED DESCRIPTION OF THE PREFERRED EMBODIMENT

Figure 6:
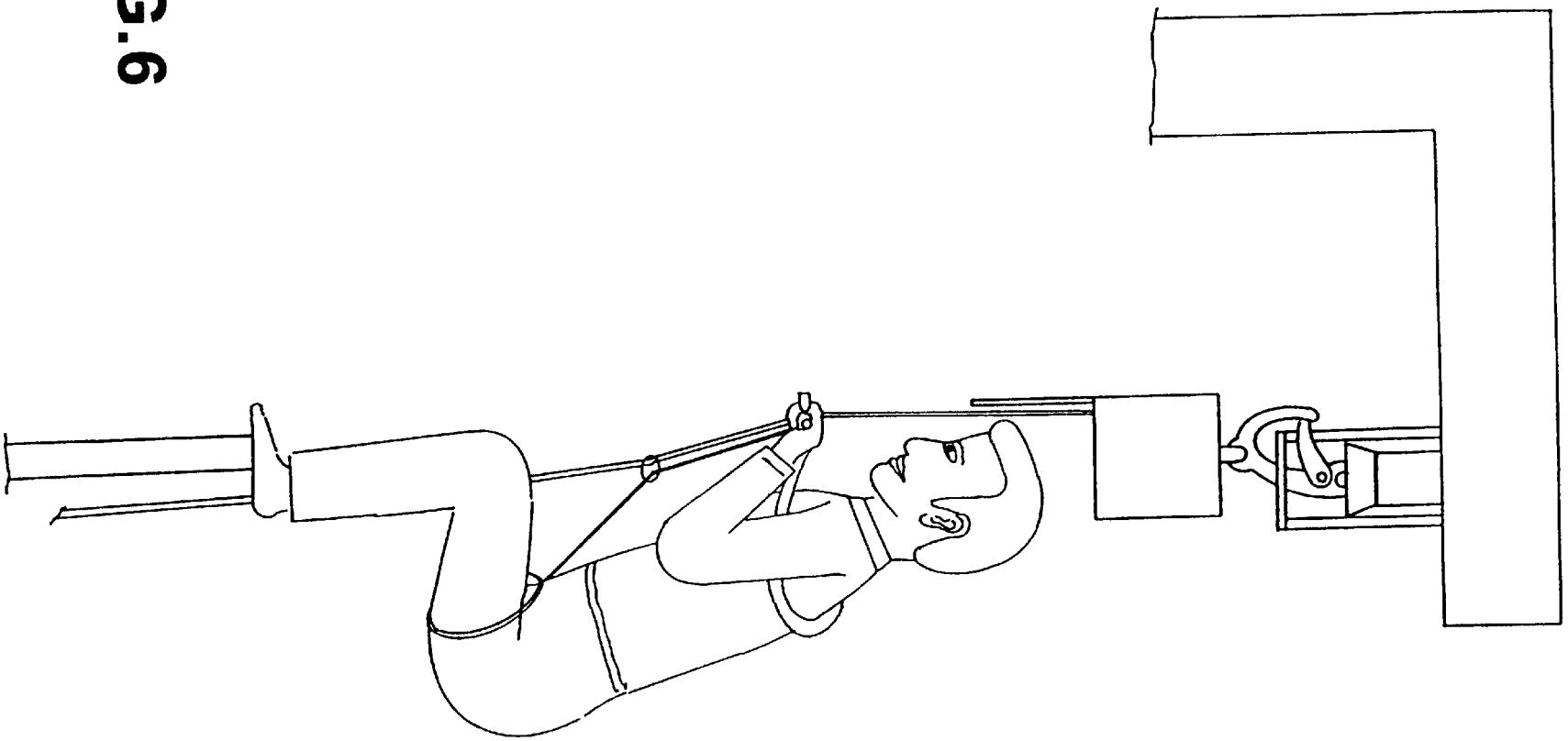
FIG. 6 is a schematic illustration of how to use the present invention.

As shown in FIG. 6, the abseil rescue system of the present invention basically comprises a velocity control system 4, a rope winder 5 with a rope 52, and a frame 6. The velocity control system 4 is held by the user, who descends along the rope 52, and acts on the rope 52.

Figure 1:
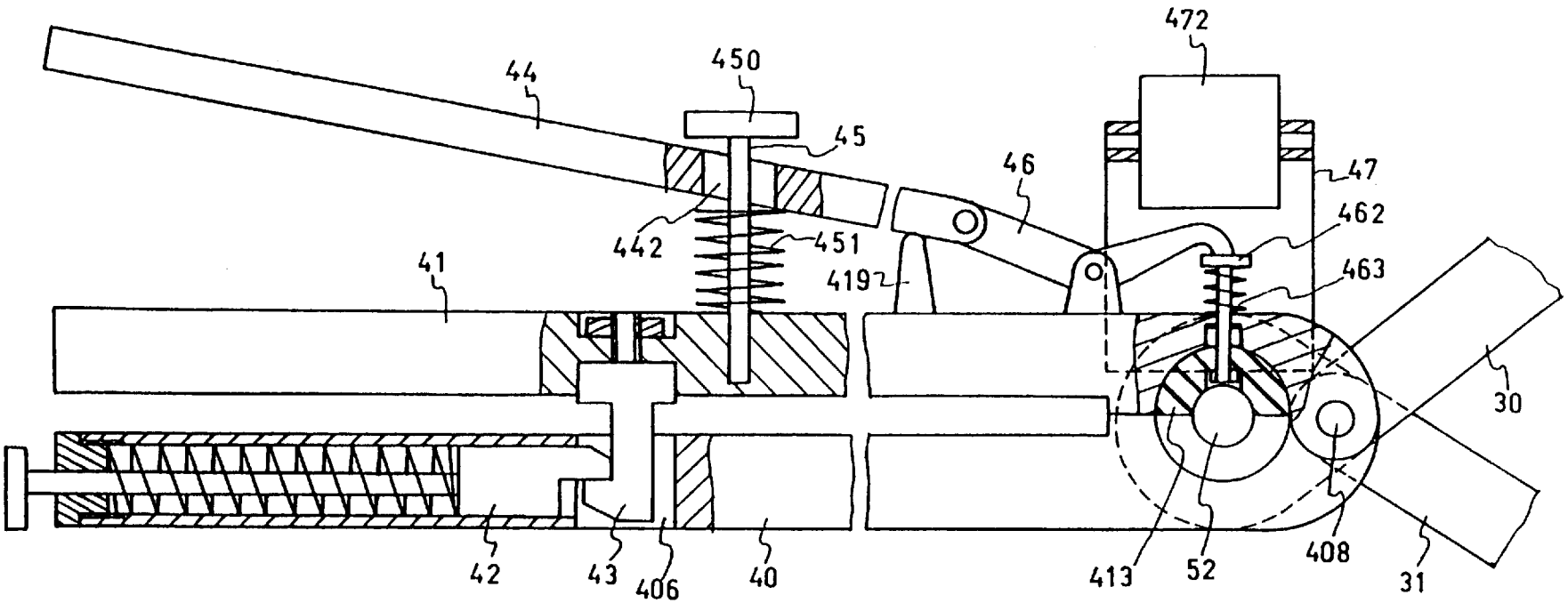
FIG. 1 is a sectional view of the velocity control system of the present invention.

Referring to FIG. 1, the velocity control system 4 comprises two retarders 40, 41 and two brakes 30, 31. A central shaft 408 connects the retarders 40, 41 and the brakes 30, 31.

Figure 2:
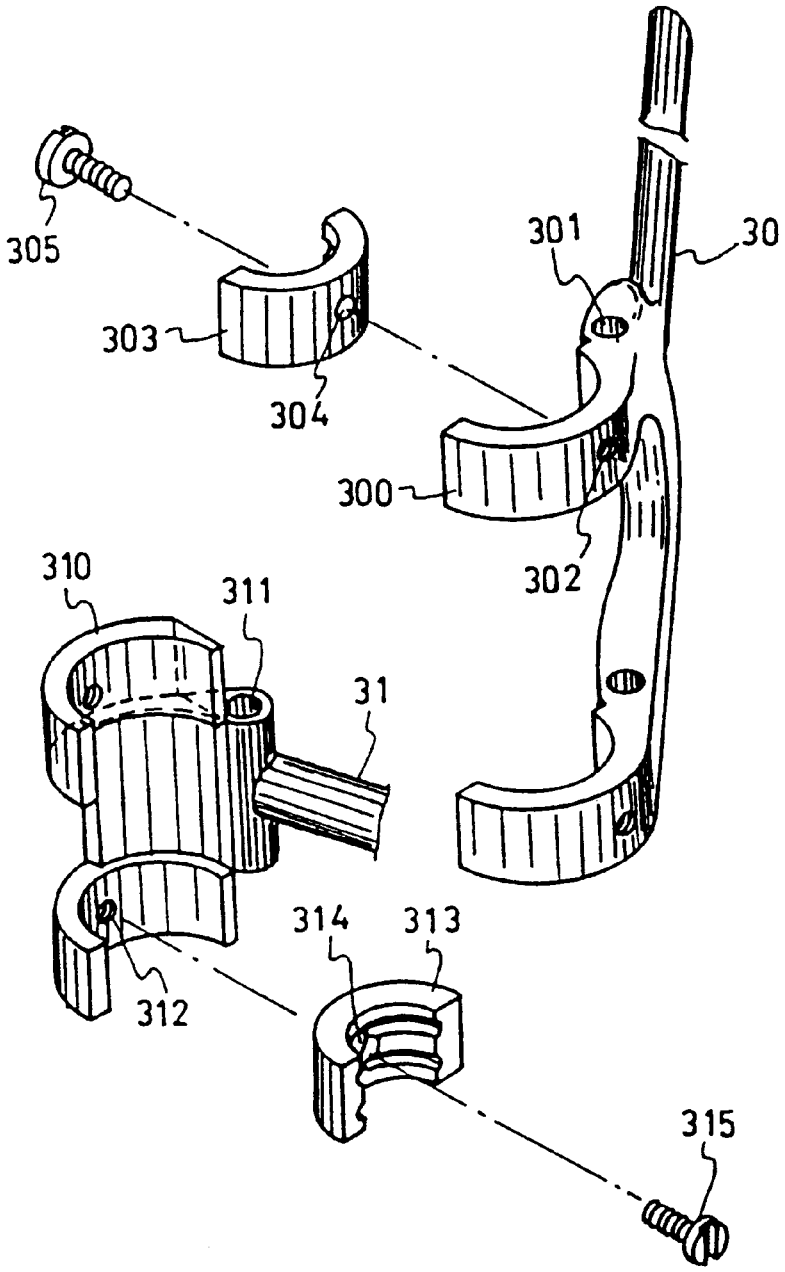
FIG. 2 is an exploded view of the brakes of FIG. 1.

Referring to FIG. 2, the brake 30 has a long, horizontal handle with a front end, where two grippers 300 are mounted. The brake 31 has a long, horizontal handle with a front end, where two grippers 310 are mounted. Close to each of the two grippers 300, away from the front end of the brake 30, a vertical hole 301 is bored through the brake 30. Close to the two grippers 310, away from the front end of the brake 31, a single vertical hole 311 is bored through the brake 31. The two holes 301 and the hole 311 are aligned, passed through by the shaft 408, for connecting to the retarders 40, 41. For applying the brakes 30, 31, the grippers 300, 310 are pressed on the rope 52, slowing the descent of the user on the rope. The grippers 300, 310 further have lateral threaded holes 302, 312 for mounting brake blocks 303, 313. The brake blocks 303, 313 have holes 304, 314, which are respectively aligned with the threaded holes 302, 312 of the grippers 300, 310. Screws 305, 315, passing through the holes 304, 302, 314, 312 fix the brake blocks 303, 313 on the grippers 300, 310.

Figure 3:
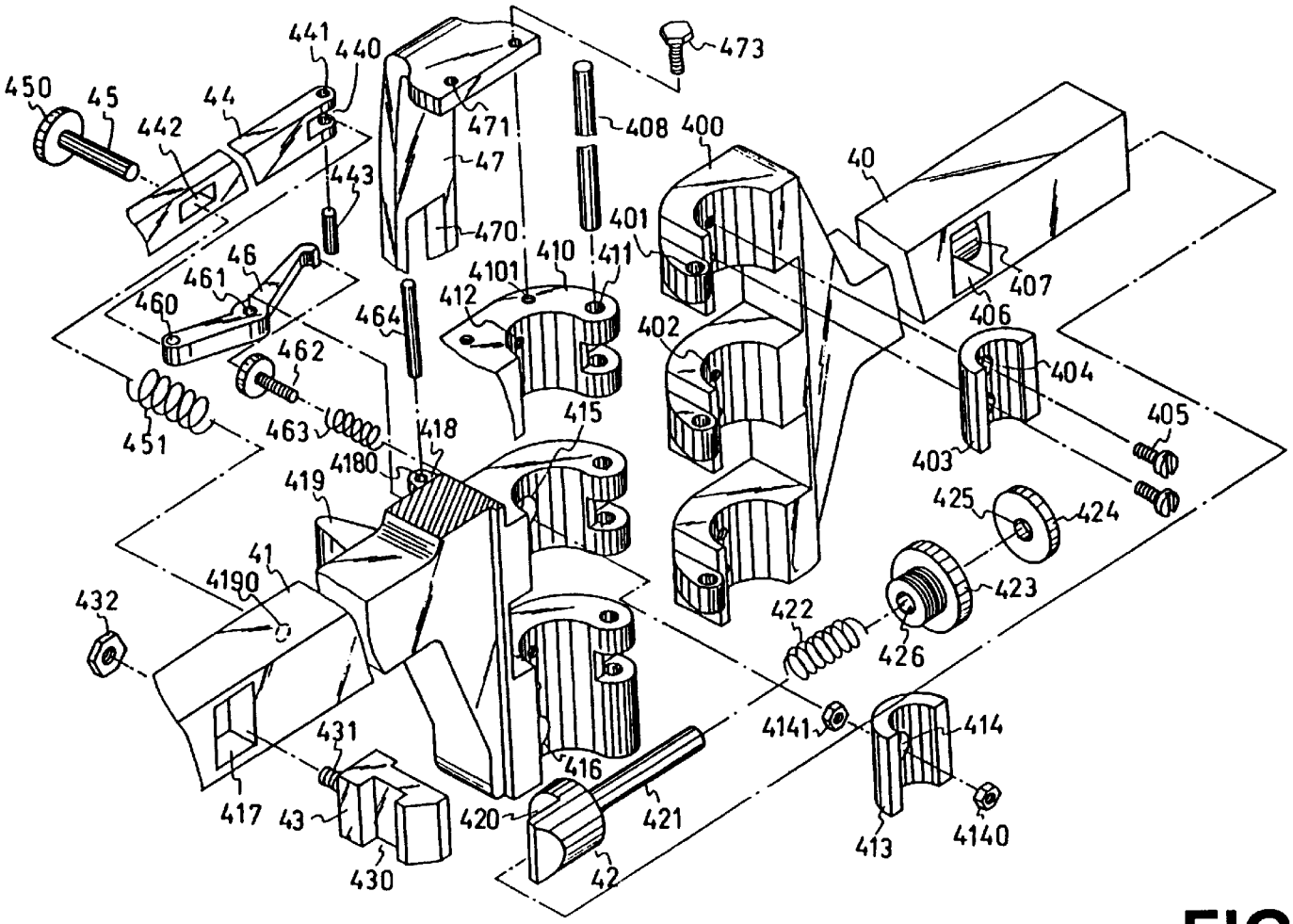
FIG. 3 is an exploded view of the retarders of FIG. 1.

Referring to FIG. 3, the retarder 40 has a long, horizontal handle with a front end, where three grippers 400 are mounted. The retarder 41 has a long, horizontal handle with a front end, where three grippers 410 are mounted. Close to the front end of the retarder 40, vertical, aligned holes 401 are bored through all grippers 400. Close to the front end of the retarder 41, a pair of vertical, aligned holes 411 is bored through each of the grippers 410, such that all holes 411 are aligned. The shaft 408 passes through the holes 401, 411 in a way that the grippers 300, 310 of the brakes 30, 31 are located between the grippers 400, 410 of the retarders 40, 41.

The grippers 400, 410 have lateral threaded holes 402, 412 for mounting brake blocks 403, 413. The brake blocks 403, 413 have holes 404, 414, which are respectively aligned with the threaded holes 402, 412 of the grippers 400, 410. Screws 405, passing through the holes 404, 402, fix the brake blocks 403 on the grippers 400. One of the grippers 410 has a relatively large hole 415 for mounting a movable brake block 413. The movable brake block 413 has a relatively large hole 414, passed through by a bolt 462 and fixed thereon by nuts 4140, 4141. The bolt 462 further passes through the hole 415, ending in a head outside the handle of the retarder 41. A coil spring 463 surrounds the bolt between the head thereof and the hole 415. Thus the grip of the gripper 410 carrying the brake block 413, is tightened by pressing on the bolt 462 and loosened by releasing the bolt 462.

The retarder 41 further has a support 418 and a projection 419 on the side of the bolt 462. The support 418 has a vertical central hole 4180. A short lever 46 with a longitudinal axis, a front end, a rear end and a middle hole 461 is mounted on the support 418, with a shaft 464 passing through the central hole 4180 and the middle hole 464. The front end of the lever 46 is located close to the head of the bolt 462. The rear end of the short lever 46 has a rear hole 460 for connecting to a long lever 44.

The long lever 44 has a longitudinal axis, a rear end and a bifurcated front end with two aligned holes 441 separated by a gap 440. The rear end of the short lever 46 is laid into the gap 440, such that the rear hole 460 and the holes 441 are aligned, with a shaft 443 passing through for hingedly connecting the short and long levers 46, 44. A horizontal opening 442 is cut through the middle of the long lever 44, perpendicular to the longitudinal axis thereof. A bolt 45 with ahead 450 passes through the opening 442 and is fixed in a hole 4190 in the retarder 41. A coil spring 451, surrounding the bolt 45, is inserted between the long lever 44 and the retarder 41. The bolt 45 presses the long lever 46, at a point between the front end thereof and the opening 442, against the projection 419 of the retarder 41.

When the rear end of the long lever 44 is pressed towards the retarder 41, the front end of the long lever 44 together with the rear end of the short lever 46 move the opposite way, and the front end of the short lever 46 presses on the bolt 462, tightening the hold of the brake block 413 on the rope 52. When the rear end of the long lever 44 is released, the spring 451 pushes the long lever 44 away from the retarder 41, and the spring 463 pushes the bolt 462 out, loosening the hold of the brake block 413 on the rope 52. Together with using the brakes 30, 31 the user of the abseil rescue system of the present invention is thus able to control the velocity of descent and to descend safely.

The retarder 40 has an opening 407 along the longitudinal axis thereof and another, adjacent horizontal opening 406 perpendicular thereto. A stud 42 with a half-flat head 420 and a main part 421 is laid into the opening 407, with the head 420 being located in the opening 406. A coil spring 422 surrounds the main part 421. A screw 423 fastened to the rear end of the retarder 40 leans against the spring 422. The main part 421 of the stud 42 passes through a central hole 426 in the screw 423 and is fastened to a central hole 425 of a pull ring 424. By pulling the pull ring 424 out of the retarder 40, the stud 42 is pulled towards the rear end of the retarder 40. The retarder 41 has a horizontal opening 417 perpendicular to the longitudinal axis thereof. A blocking part 43 comprising a latch bolt 430 and a threaded bolt 431 is inserted in the opening 417 and fastened there by a nut 432 on the threaded bolt 431. When the retarders 40, 41 are located next to each other, the latch bolt 430 of the blocking part 43 enters the opening 406 and engages with the head 420 of the stud 42, keeping the retarders 40, 41 next to each other.

The lowest of the grippers 410 has a lateral hole 416 for fastening a protective suit for the user to increase safety. The highest of the grippers 410 has holes 4101 on the top for mounting a side cover 47. The side cover 47 has holes 471. Screws 473 fasten the side cover 47 to the gripper 410 at the holes 471, 4101. The cover 47 has an opening 470, in which rolls 472 are mounted. The side cover 47 protects the long lever 44 and the hands of the user from the wall along which the user descends. Bumps against the wall are softened, and any fear of the user, especially of children, during descent is alleviated.

When the abseil rescue system of the present invention is used, the grippers 400, 410 of the retarders 40, 41 are put around the rope. The retarders 40, 41 are held next to each other by the blocking part 43 engaging with the stud 42. Depending on her or his weight, the user decides whether to use the long lever 44 to apply the movable brake block 413. Furthermore, the user puts the grippers 300, 310 of the brakes 30, 31 around the rope. If necessary, the effect of the brakes is enhanced by using the long lever 44.

Figure 4:
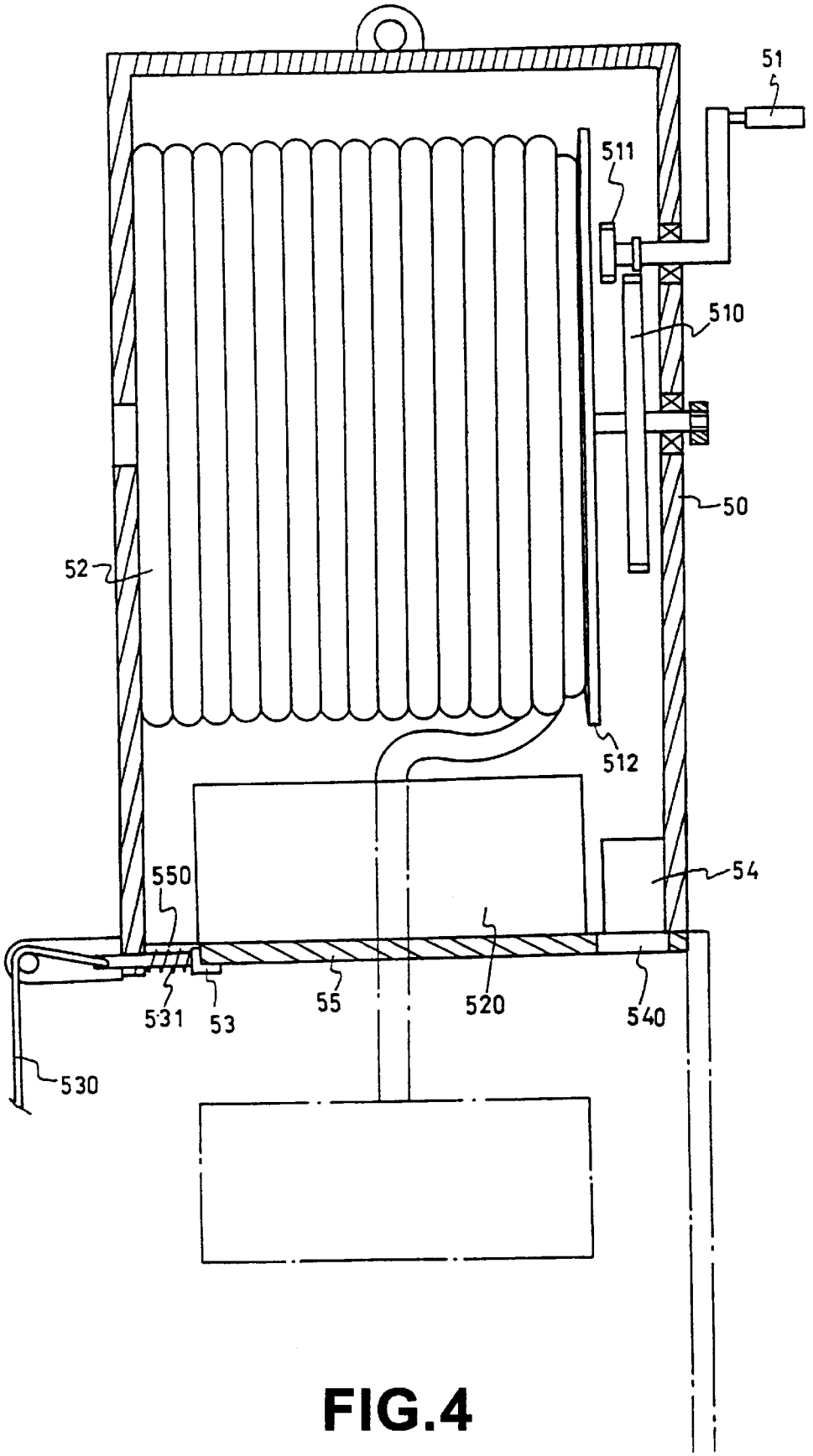
FIG. 4 is a sectional view of the rope winder of the present invention.
Figure 5:
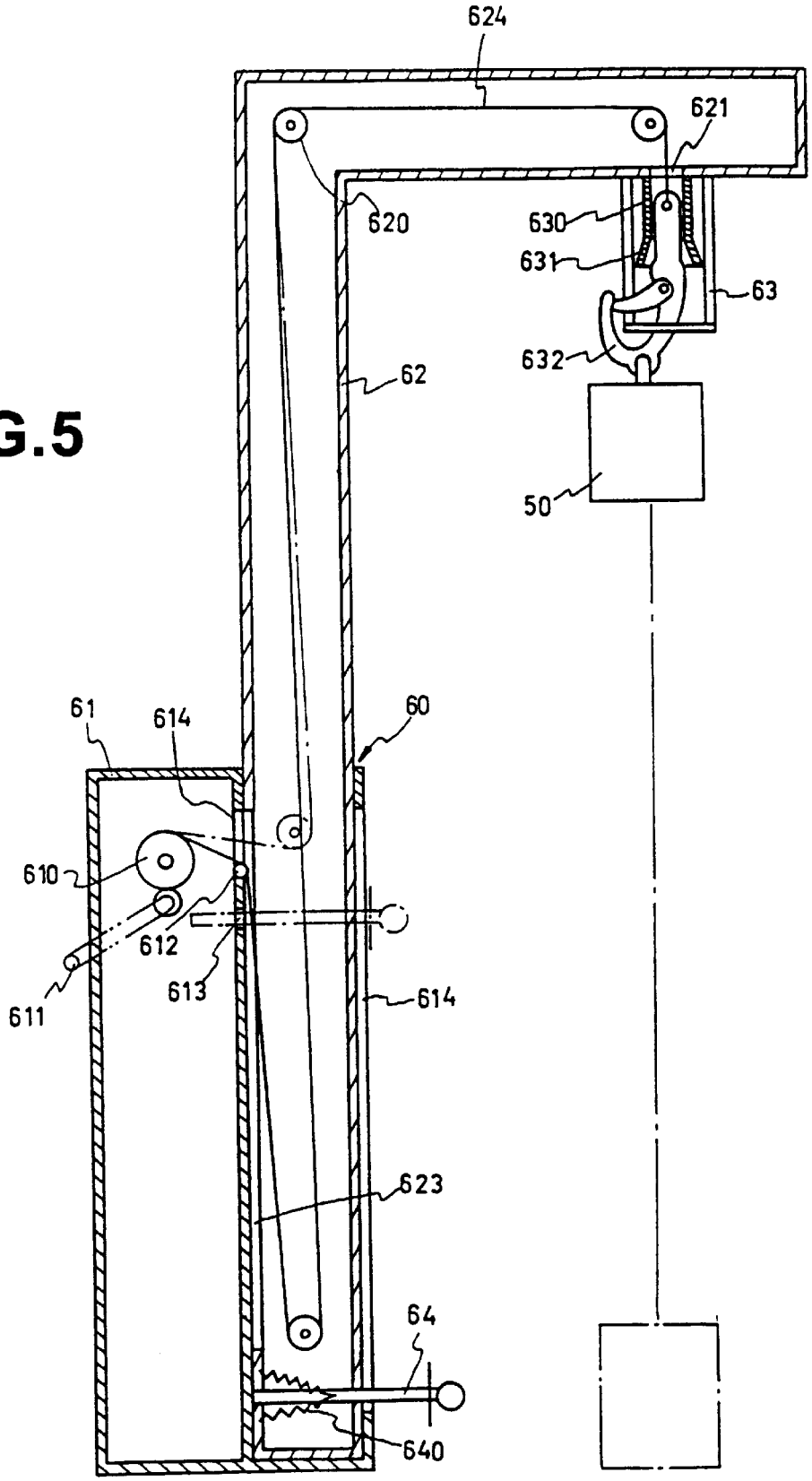
FIG. 5 is a sectional view of the frame of the present invention.

Referring to FIG. 4, the rope winder 5 comprises the rope 52, wound up on a reel 512 inside a rope box 50 with a bottom 55. The reel 512 is turned by a crank 51 via two cogs 511, 510. The crank 51 is axially movable for engaging or disengaging the two cogs 511, 510. A lamp 54 is installed on the bottom 55 inside the rope box 50, its light emanating through a transparent plate 540 within the bottom 55. The bottom 55 is in one of two states, either fixed on the rope box 50 or flapped outward. In the fixed state, the bottom 55 is secured by a latch 53, held by a rod 531, which has an outer end that extends to the outside of the rope box 50. A coil spring 531 around the rod 550 presses the latch 53 against the bottom 55, securing it. An escape cord 530 is fixed to the outer end of the rod 550.

For using the abseil rescue system of the present invention, the user suspends the rope winder 5 and pulls the escape cord 530 to release the hold of the latch 53, such that the bottom 55 flaps out. Then the rope 52 comes out, and the user attaches the brakes 30, 31 and the retarders 40, 41 at the rope 52. The rope 52 has a free end with a soft body 520 as a landing platform for the feet of the user to reduce the landing shock. For winding up the rope 52, the crank 51 is moved to engage the two cogs 511, 510 and then turned, until the rope 52 is completely stored inside the rope box 50. The bottom 55 is folded up into the fixed state and secured by the latch 53. Of course, for the abseil rescue system of the present invention a common rope can be used as well.

Referring to FIG. 6, the main purpose of the frame 6 is to allow for suspending the rope winder 5 quickly in a high position, such that a high part of the body of the user is supported. In a conventional rescue device a low part of the body of the user is supported during descent, so there is no support in the first moment, and the user has to overcome a high psychological barrier to jump, delaying the rescue operation. Furthermore, the rope of a conventional rescue device is too heavy to suspend, especially for women and children.

The frame 6 comprises a base 61 and a gallows 62 with an upper front end. The base 61 has a back part with a reel 610, the rotation of which is driven by a crank 611. A transmission cord 624 is wound around the reel 610. The gallows 62 is supported by the base 61, vertically gliding therein. The gallows 62 has a low position, resting on the bottom of the base 61, or a high position, held by a holding bar 64. The holding bar 64 penetrates the gallows 62 and a hole 613, in which it is pressed by a spring 640. The transmission cord 624 has a free end, which passes through an opening 614 of the base 61 and an opening 623 of the gallows 62. A role 612 at the opening 613 supports the transmission cord 624. The transmission cord 624 is led to the upper front end of the gallows 62. The free end of the transmission cord 624 carries a hook 632, on which the rope box 50 or a conventional rope is suspended. The hook 632 and the transmission cord 624 are guided by a guiding tube 630 with a lower opening 631 inside a casing 63, which is connected to the inside of the gallows by a hole 621. Reels 620 guide the transmission cord 624 inside the gallows 62.

When using the abseil rescue system of the present invention, the user lifts the rope box 50 by turning the crank 611. When the hook 32 is held in the casing 63, the user continues turning the crank 611, causing one of the reels 620 to rise along with the gallows 62, until the gallows 62 is in the high position, with the holding bar 64 entering the hole 613. Then the user pulls the escape cord 530, causing the bottom 55 of the rope box 50 to flap out and releasing the rope 52. The user puts the retarders 40, 41 around the rope 52 and starts descending, as shown in FIG. 6.

I claim:

1. An abseil rescue system, allowing a user to descend on a rope, comprising:

a velocity control system, comprising a first brake and a second brake, said first brake having a front end with a plurality of grippers, said second brake having a front end with a plurality of grippers with a gap, said plurality of grippers of said first brake located in said gap of said plurality of grippers of said second brake, said first and second brakes being hingedly connected by a shaft, with said plurality of grippers thereof for gripping said rope, and a first retarder and a second retarder, said first and second retarder having front ends with pluralities of alternatingly arranged grippers with gaps, said pluralities of grippers of said first and second brakes located in said gaps of said pluralities of grippers of said first and second retarders, said first retarder having a stud, said second retarder having a blocking part for engaging with said stud to keep said first and said second retarders parallel and next to each other, said stud being movable against an elastic force of a spring for disengaging from said blocking part, said first and second retarders being hingedly connected by said shaft either, with said plurality of said grippers thereof for gripping said rope;

whereby, said plurality of grippers on said first and second brakes can be operated to clamp said rope crookedly so that a velocity control can be reached due to an increased friction force, and said first and second retarders can keep grasping said rope to slow down the descending speed.

2. An abseil rescue system according to claim 1, wherein said second retarder has an auxiliary braking device, comprising:

a long lever with a front end and a rear end;

a short lever with a front end, a rear end, the rear end of the short lever is hingedly connected to said front end of said long lever, said long lever having a middle hole, which is hingedly connected to said second retarder;

a bolt, pressed on by said front end of said short lever and acting on a movable brake block; and a projection on said second- retarder, supporting said long lever between said front end and said rear end thereof.

3. An abseil rescue system according to claim 2, wherein said auxiliary braking device has a side cover.

* * * * *